US006976467B2

(12) United States Patent
Fantuzzi

(10) Patent No.: US 6,976,467 B2
(45) Date of Patent: Dec. 20, 2005

(54) RECIPROCATING INTERNAL COMBUSTION ENGINE

(75) Inventor: Luciano Fantuzzi, Brescello (IT)

(73) Assignee: Fantuzzi Reggiane Corporation Holding S.A., Luxemborg (LU)

( * ) Notice: Subject to any disclaimer, the term of this patent is extended or adjusted under 35 U.S.C. 154(b) by 0 days.

(21) Appl. No.: 10/488,337

(22) PCT Filed: Aug. 13, 2002

(86) PCT No.: PCT/EP02/09074

§ 371 (c)(1),
(2), (4) Date: Feb. 27, 2004

(87) PCT Pub. No.: WO03/021082

PCT Pub. Date: Mar. 13, 2003

(65) Prior Publication Data

US 2004/0261732 A1 Dec. 30, 2004

(30) Foreign Application Priority Data

Aug. 28, 2001 (IT) ..... MO2001A0174

(51) Int. Cl.[7] ..... F02B 75/32
(52) U.S. Cl. ..... 123/197.1; 123/197.3
(58) Field of Search ..... 123/197.1, 197.3, 123/197.4

(56) References Cited

U.S. PATENT DOCUMENTS

| | | | | |
|---|---|---|---|---|
| 1,374,164 A | | 4/1921 | Nordwick | |
| 1,654,378 A | | 12/1927 | Marchetti | |
| 3,967,599 A | | 7/1976 | Townsend | |
| 4,545,336 A | | 10/1985 | Waide | |
| 4,996,953 A | | 3/1991 | Buck | |
| 5,060,603 A | * | 10/1991 | Williams | 123/78 BA |
| 5,890,465 A | * | 4/1999 | Williams | 12/197.4 |
| 6,125,802 A | * | 10/2000 | Pen | 123/48 B |
| 6,408,814 B2 | * | 6/2002 | Shigemori | 123/197.4 |
| 2001/0017122 A1 | | 8/2001 | Fantuzzi | |
| 2002/0007813 A1 | * | 1/2002 | Shigemori | 123/197.1 |

FOREIGN PATENT DOCUMENTS

| | | | |
|---|---|---|---|
| EP | 0 064 726 | | 11/1982 |
| FR | 692 183 | | 10/1930 |
| FR | 1 541 589 | | 10/1968 |
| GB | 309 334 | | 4/1929 |
| GB | A-309 334 A | | 4/1929 |
| JP | 56088918 | * | 7/1981 |

* cited by examiner

*Primary Examiner*—John T. Kwon
(74) *Attorney, Agent, or Firm*—Wolf, Greenfield & Sacks P.C.

(57) ABSTRACT

The reciprocating internal-combustion engine comprises at least one hollow cylinder, with a chamber inside a working fluid, the chamber has an end closed by a head and an opposite end closed by a piston that reciprocates by rectilinear motion in the chamber between a bottom dead center and a top dead center, and a device for converting the reciprocating rectilinear motion into a rotary motion of a driving shaft. The conversion device comprises at least one push rod substantially perpendicular to the shaft with a first end associated with the piston and a second end provided with pusher elements, and at least one contoured eccentric element keyed on the shaft on which a circuit element is provided which is crossed by the pusher elements and adjustment elements for adjusting sliding of the pusher elements along the circuit element so as to keep the rod and the piston in a substantially stationary configuration for a presettable rotation angle of the driving shaft.

15 Claims, 5 Drawing Sheets

RECIPROCATING INTERNAL COMBUSTION ENGINE

The present invention relates to an improved reciprocating internal-combustion engine.

It is known that reciprocating internal-combustion engines of the spark-ignition or compression-ignition type allow to convert a working fluid into useful energy.

These engines have a cyclic operation that comprises the strokes of induction, compression, power-expansion, and exhaust of the fluid.

The working cycles of known kinds of internal-combustion engine can be approximated with the ideal Sabathé thermodynamic cycle, which reproduces the combustion stroke with two conversions: a first one at constant volume and a second one at constant pressure.

Two other ideal thermodynamic cycles are also known which are simplifications of the Sabathé cycle: the Otto cycle, in which combustion is represented with a constant-volume conversion, and the Diesel cycle, in which combustion is represented with a constant-pressure conversion.

It is known that the thermodynamic efficiency of the ideal Otto cycle is, for an equal compression ratio, higher than that of the ideal Diesel or Sabathé cycles.

Part of the loss of the thermodynamic efficiency of the real working cycle of an engine with respect to that of an ideal thermodynamic cycle is unquestionably due to the manner in which the combustion process occurs and to the connections between the pistons and the driving shaft.

The connection mechanisms of known kinds of engine are constituted by rod-and-crank systems that allow to convert the reciprocating rectilinear motion of the pistons into the rotary motion of the driving shaft.

The pistons are connected to the driving shaft by means of a connecting rod, in which the small end is pined to the pin of the pistons and the big end is coupled to the crank pin of the driving shaft.

The small end moves with a reciprocating rectilinear motion together with the respective piston, while the big end traces a circumference whose radius is equal to half the stroke of the piston, i.e., the crank radius.

These known kinds of reciprocating internal-combustion engine are not devoid of drawbacks, including the fact that their thermodynamic efficiencies are far lower than the ideal ones, they do not allow constant-volume combustion, and they entail high specific consumptions.

The aim of the present invention is to eliminate the above mentioned drawbacks of known types of engine, by providing an improved reciprocating internal combustion engine that allows to improve the thermodynamic efficiency of the working cycle, to obtain a combustion that is close to the combustion provided by the Otto cycle, to reduce specific consumption and to increase the power that can be obtained for an equal displacement and rpm rate.

Further objects of the present invention are to increase the ratio between the power output and the weight of the engine and between the power output and the dimensions of the engine, to reduce the complicated articulations in the motion transmission, to simplify the elements for transmitting power from the combustion chamber to the output of the driving shaft, and to attenuate the imbalances and vibrations of the alternating masses.

Within this technical aim, another object of the present invention is to achieve the above aim and objects with a structure that is simple, relatively easy to provide in practice, safe in use, effective in operation, and relatively modest in cost.

This aim and this object are both achieved by the present improved reciprocating internal-combustion engine, of the type that comprises at least one hollow cylinder, inside which there is a chamber for the evolution of a working fluid, said chamber having an end that is closed by a head and an opposite end that is closed by a piston that can slide with a reciprocating rectilinear motion in said chamber between a bottom dead center, which determines the maximum distance from said head, and a top dead center, which determines the minimum distance from said head, and a device for converting said reciprocating rectilinear motion into a rotary motion of a driving shaft that comprises at least one push rod, which is substantially perpendicular to said shaft and has a first end associated with the piston and a second end provided with pusher elements, and at least one contoured eccentric element that is keyed on said shaft and on which there is a circuit element that can be followed by said pusher elements that are mechanically connected thereto, the action or evolution of the fluid in the chamber imparting to the piston a thrust for actuating the rod with a reciprocating rectilinear motion, with the sliding of the pusher elements along the circuit element so as to transfer said thrust to the eccentric element for the rotary actuation of the driving shaft, characterized in that it comprises means for adjusting said sliding of the pusher elements along the circuit element which, when the piston is at least proximate to one of said dead centers, are suitable to keep the rod and the piston in a substantially stationary configuration for a presettable rotation angle of the driving shaft.

Further characteristics and advantages will become better apparent from the detailed description of a preferred but not exclusive embodiment of an improved reciprocating internal-combustion engine, illustrated only by way of non-limitative example in the accompanying drawings, wherein.

Figure 1:
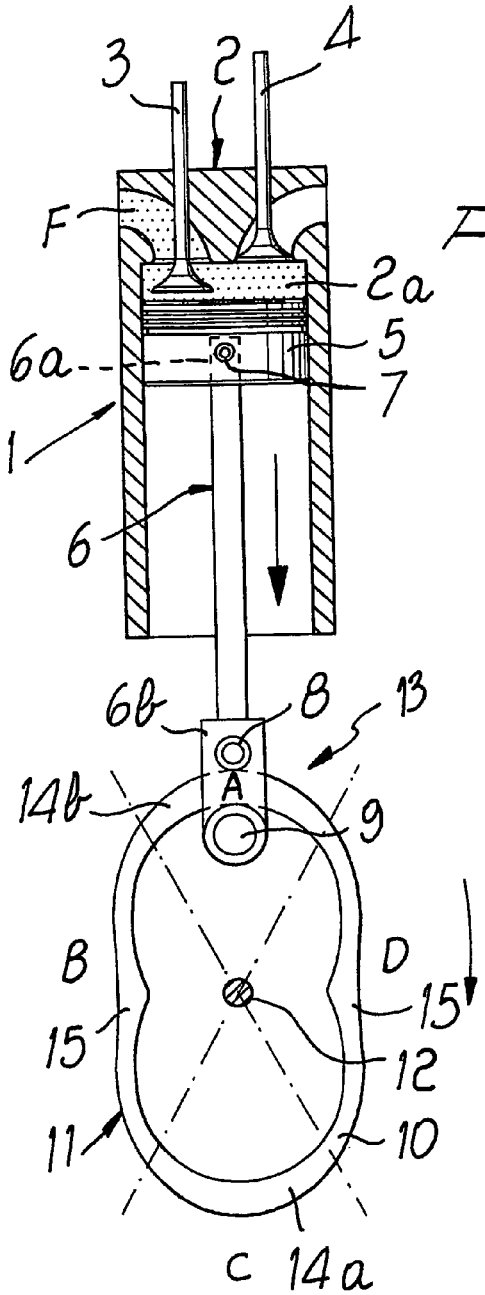
FIG. 1 is a partially sectional schematic view of an improved reciprocating internal-combustion engine according to the present invention at the beginning of the induction stroke.

With particular reference to the figures, the numeral 1 designates a cylinder of an improved reciprocating internal-combustion engine M according to the present invention.

The cylinder 1 has an end that is closed by a head 2 provided with an inlet port for a working fluid F, which is controlled by an inlet valve 3, and an exhaust port for fluid F, which is controlled by an exhaust valve 4; the opposite end of the cylinder 1 is closed by a piston 5, which can slide with a reciprocating rectilinear motion inside said cylinder 1.

The working fluid F enters the chamber 2*a* formed by the inner walls of the cylinder 1, by the crown of the piston 5 and by the lower surface of the head 2, and evolves thermodynamically inside the chamber 2*a* when said chamber varies its dimensions.

The piston 5 is rigidly associated with a first end 6*a* of a push rod 6 or other equivalent connection element by means of a pin 7, while the second end 6*b* of the rod 6 is provided with pusher elements, which are constituted by a first pin 8 or roller or wheel or the like and by a second pin 9 or roller or wheel or the like and are mechanically coupled so as to slide along a circuit element 10 formed on a contoured eccentric element 11.

The eccentric element 11 is constituted by a disk-like body that is keyed on a driving shaft 12 and on one face of which there is in relief the circuit element 10.

The first pin 8 and the second pin 9 slide respectively along the outer profile and along the inner profile of the circuit element 10.

The shaft 12, which is rectilinear and perpendicular to the rod 6, becomes a driving shaft by virtue of the energy conversion of the fluid F that moves the piston 5.

The circuit element 10 is constituted by two lobes, which are mutually blended and offset at 180° to each other with two portions for each lobe, so that the evolution of the working fluid F in the chamber 2*a* occurs in 360° of rotation of the shaft 12.

The reference letters A, B, C and D designate the theoretical points between which the four strokes occur along the respective portions AB, BC, CD, and DA of the circuit element 10.

The piston 5 transmits the motion to the shaft 12 by virtue of the end 6*b* of the rod 6, which is coupled mechanically, by virtue of the first pin 8 and the second pin 9, so as to follow the circuit element 10 of the eccentric element 11, which rotates at the same rate as the shaft 12.

Figure 2:
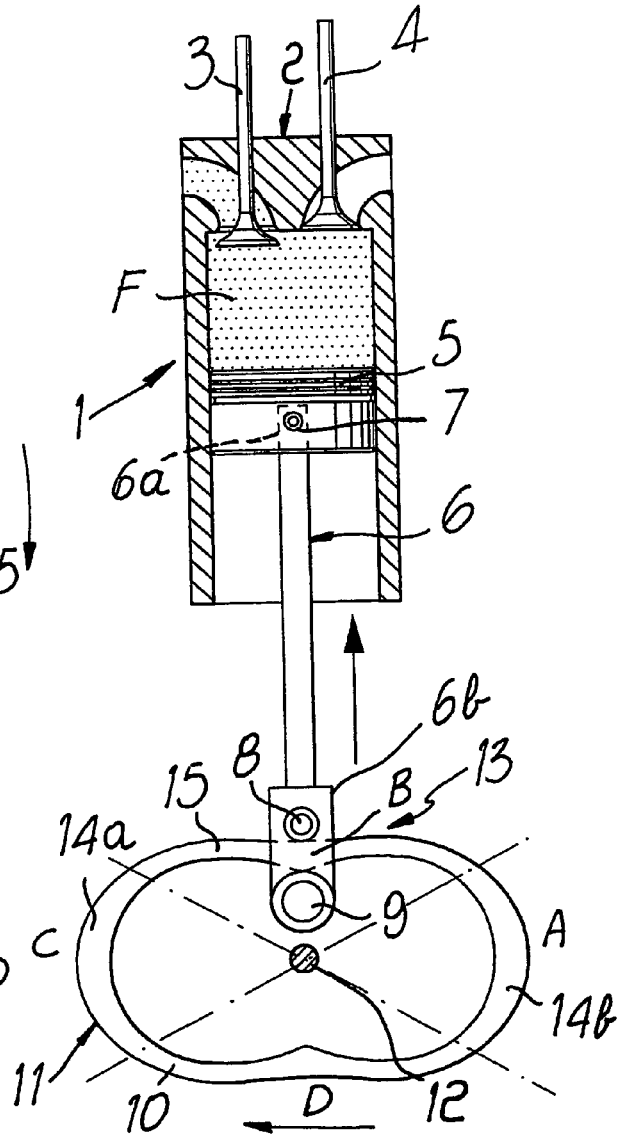
FIG. 2 is a partially sectional view of the engine of FIG. 1 at the beginning of the compression stroke.
Figure 3:
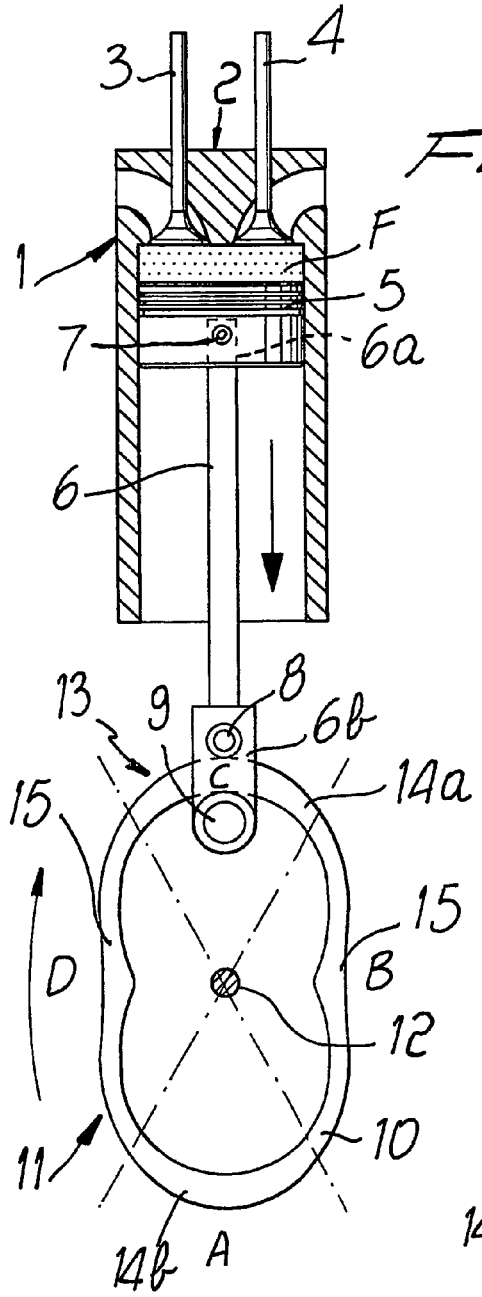
FIG. 3 is a partially sectional view of the engine of FIG. 1 at the beginning of the power-expansion stroke.
Figure 4:
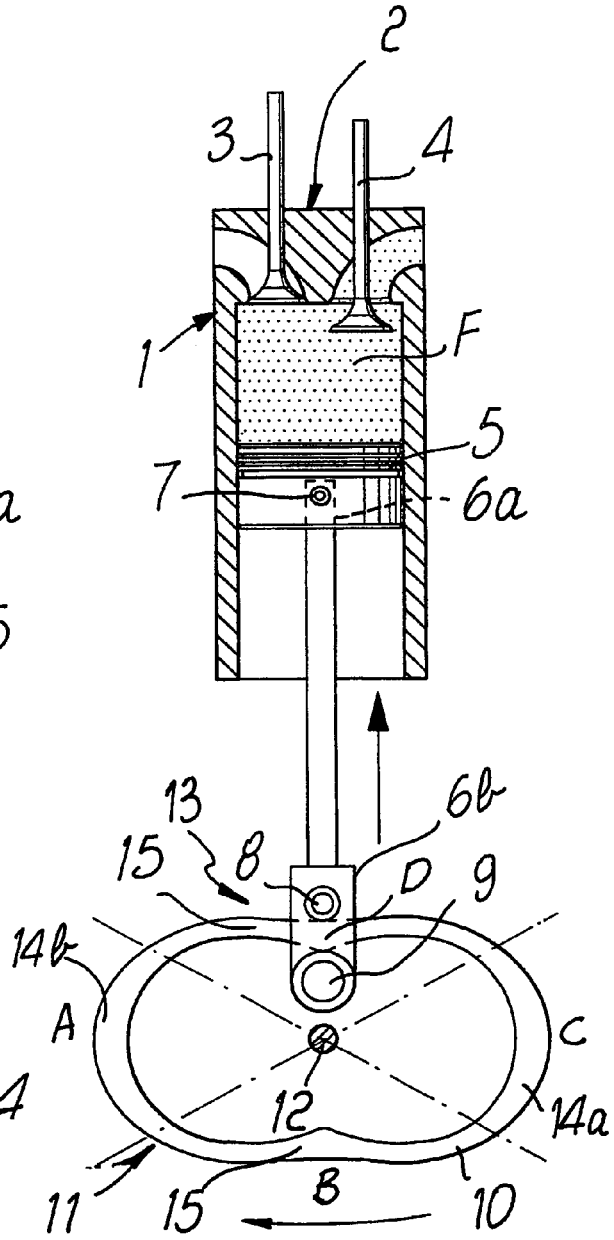
FIG. 4 is a partially sectional view of the engine of FIG. 1 at the beginning of the exhaust stroke.

The motion of the shaft 12 is substantially constant, while the piston 5 has a periodic motion whose speed can vary between two nil values: the top dead center (TDC), shown in FIGS. 1 and 3, which corresponds to the points A and C of the circuit element 10, and the bottom dead center (BDC), show in FIGS. 2 and 4, which corresponds to the points B and D of the circuit element 10.

During motion from the TDC to the BDC and vice versa, the piston 5 defines a volume (displacement) that is calculated as a product of the surface of the crown of the piston 5 and the stroke of said piston.

The inflow and outflow of the working fluid F are regulated respectively by the inlet valve 3 and by the exhaust valve 4.

The engine according to the invention furthermore comprises adjustment means 13 for adjusting the sliding of the first pin 8 and of the second pin 9 along the circuit element 10, which keep the rod 6, and therefore the piston 5, in a substantially stationary configuration, for a presettable rotation angle of the shaft 12, when the piston 5 is proximate to the TDC and/or BDC.

When the piston 5 is proximate to the TDC that corresponds to the combustion stroke (point C), during said combustion the volume of the chamber 2*a* remains substantially constant and this allows to provide a working cycle that is close to the ideal Otto cycle with constant-volume combustion.

Likewise, when the piston 5 is proximate to the TDC that corresponds to the induction stroke (point A) and/or proximate to the BDC that corresponds to the exhaust stroke (point D), during these strokes the volume of the chamber 2*a* remains substantially constant, and this allows to provide a working cycle with induction and/or exhaust at constant volume.

The adjustment means 13 comprise blending regions 14*a* and 14*b* that are shaped like circular arcs, correspond to said presettable angle of rotation of the shaft 12, and respectively connect the two portions BC and CD, which constitute one of the two lobes at the point C, and the two portions AB and DA, which constitute the other lobe at the point A.

The adjustment means 13 furthermore comprise blending regions 15 that are shaped like circular arcs, correspond to said presettable angle of rotation of the shaft 12, and respectively connect the two portions CD and DA at the point D and the two portions AB and BC at the point B.

The breadth of the circular arc of the blending regions 14*a* and 14*b* and 15 is between 5 and 60 sexagesimal degrees.

FIG. 1 illustrates the induction stroke, in which the fluid F enters the chamber 2*a* through the inlet port, the inlet valve 3 being open and the exhaust valve 4 being closed.

The induction stroke is performed in 90° of the rotation of the shaft 12: it begins when the piston 5 is at the TDC, the first pin 8 and the second pin 9 being at the point A of the circuit element 10, and ends when the piston 5 reaches the BDC, the first pin 8 and the second pin 9 being at the point B of the circuit element 10.

The blending region 14*b*, formed at the point A (TDC), allows to keep stationary the rod 6 and the piston 5 for a rotation angle of the shaft 12 that corresponds to the induction stroke.

FIG. 2 illustrates the compression stroke, which begins with the piston 5 at the BDC, with the inlet valve 3 in the closure step and the exhaust valve 4 completely closed, and ends with the piston 5 at the TDC (point C).

The compression stroke corresponds to the portion BC of the circuit element 10 traced by the first pin 8 and the second pin 9 and is performed during the subsequent 90° of the rotation of the shaft 12.

FIG. 3 illustrates the useful step of combustion and expansion that begins with the piston 5 at the TDC (point C) and with the valves 3 and 4 closed and ends when the piston 5 reaches the BDC (point D).

The useful stroke corresponds to the portion CD of the circuit element 10 and is performed in 90° of rotation of the shaft 12.

The blending region 14*a* formed at the point C (TDC) allows to keep the rod 6 and the piston 5 stationary for a certain rotation angle of the shaft 12, during which the combustion step occurs; combustion-expansion is completed along the arc CD.

Finally, FIG. 4 illustrates the exhaust stroke, which begins with the piston 5 at the BDC (point D), the exhaust valve 4 open and the inlet valve 3 closed, and ends when the piston 5 reaches the BDC (point A).

The exhaust stroke corresponds to the portion DA of the circuit element 10 and is performed in 90° of rotation of the shaft 12.

In this case, the blending region 15, formed at the point D (BDC), allows to keep stationary the rod 6 and the piston 5, for a rotation angle of the shaft 12 that corresponds to the exhaust stroke.

The improved engine in, the illustrated embodiment is therefore a four-stroke engine in which the various steps of the cycle follow one another serially during a single revolution (360°) of the driving shaft, while in known kinds of engine they follow one another during two revolutions.

Accordingly, the number of useful strokes per cycle is doubled: the power in output from the driving shaft doubles with respect to the power in output from the shaft of an equivalent conventional four-stroke engine for an equal displacement and rpm rate.

Advantageously, the number of useful strokes that can be obtained at each revolution of the driving shaft 12 increases by modifying the profile of the eccentric element 11 or of the circuit element 10; for example, it is possible to have three, four or more useful strokes for each revolution.

The circuit element 10 can in fact be constituted by three lobes that are mutually blended and offset at 120° with respect to each other with two portions for each lobe, so that the evolution of the working fluid in the chamber 2*a* occurs in 240° of revolution of the shaft 12.

As an alternative, there can be four lobes that are mutually blended and offset at 90° to each other with two portions for each lobe, so that the evolution of the working fluid in the chamber 2*a* occurs in 180° of a revolution of the shaft 12.

Figure 7:
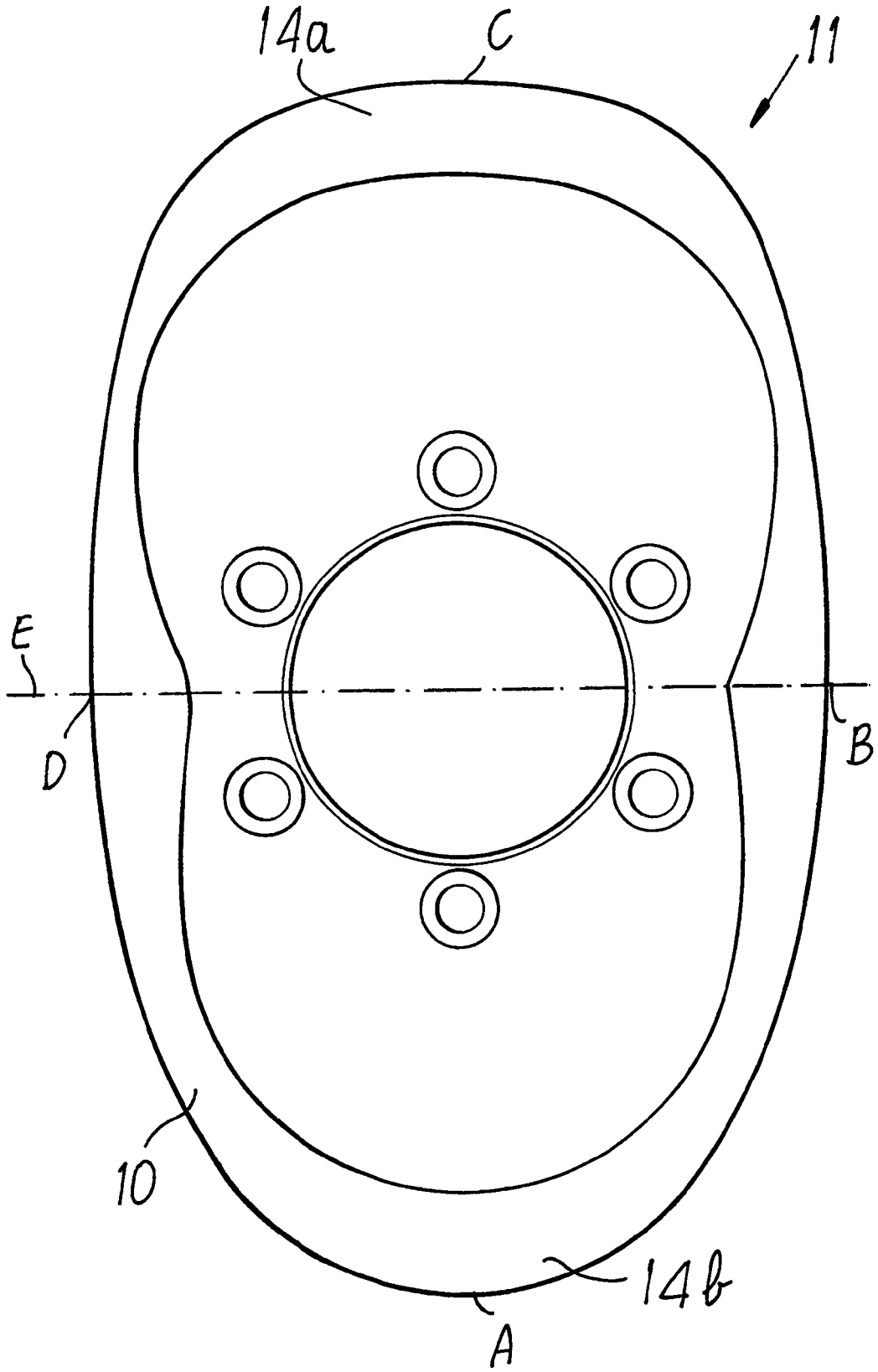
FIG. 7 is a schematic view of a possible alternative embodiment of the eccentric element of the engine according to the invention.

FIG. 7 illustrates a possible alternative embodiment of the eccentric element 11, the circuit element 10 of which is of the type with two mutually opposite lobes arranged at 180°, each lobe being divided into two portions, respectively AB and AD and BC and CD.

One of the two lobes (formed by the portions AB and AD) has an average radius of curvature, with respect to the center of the eccentric element 11, that is smaller than the average radius of curvature of the other lobe (formed by the portions BC and CD), the blending region between the two portions that constitute it (point A) being the region that corresponds to the induction TDC, while the blending region between the two portions that constitute the other lobe (point C) is the one that corresponds to the combustion TDC.

The circuit element 10 is therefore asymmetric with respect to a central axis whose trace is designated by the reference letter E.

Figure 5:
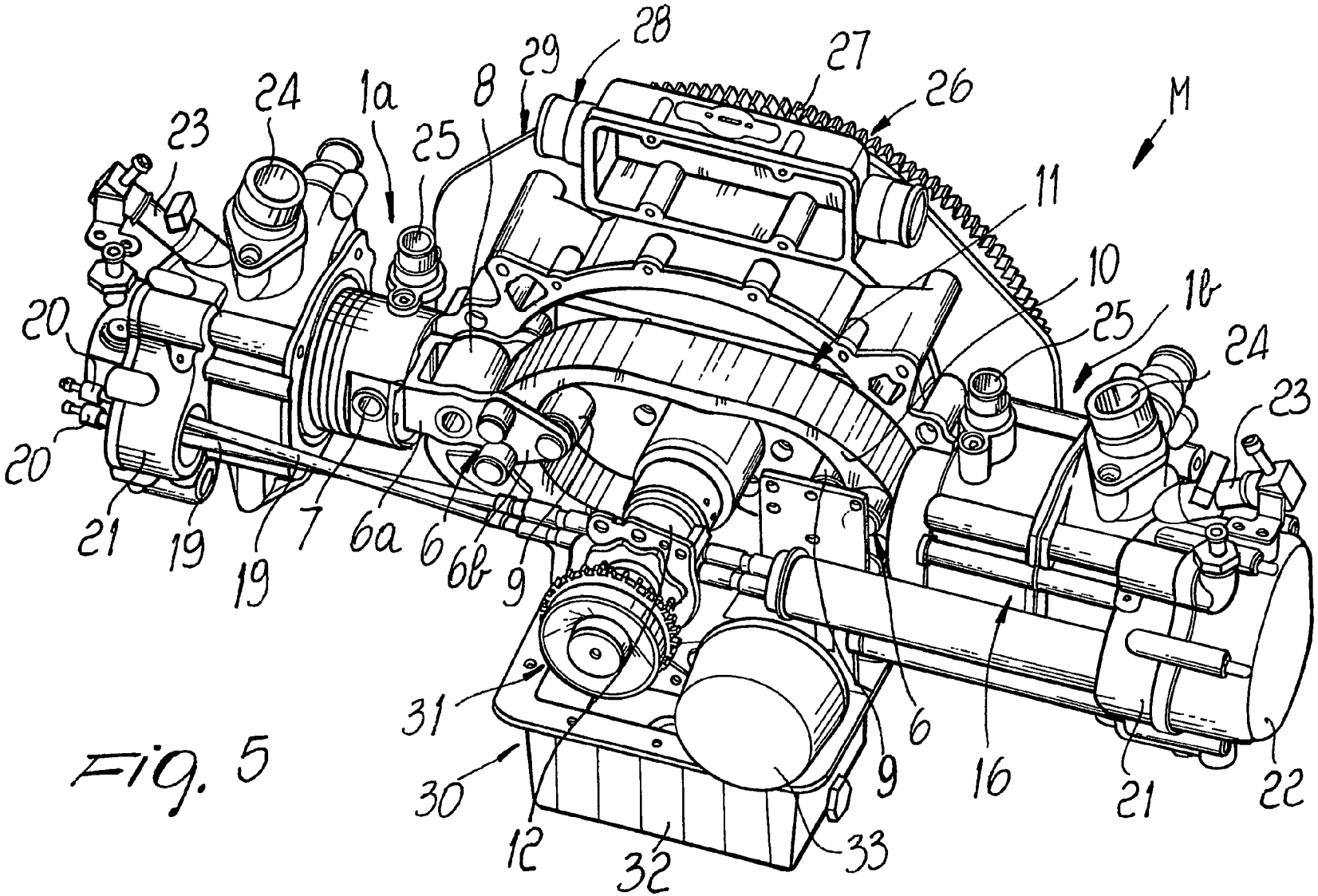
FIG. 5 is a schematic axonometric view of an engine according to the invention of the flat-twin type.
Figure 6:
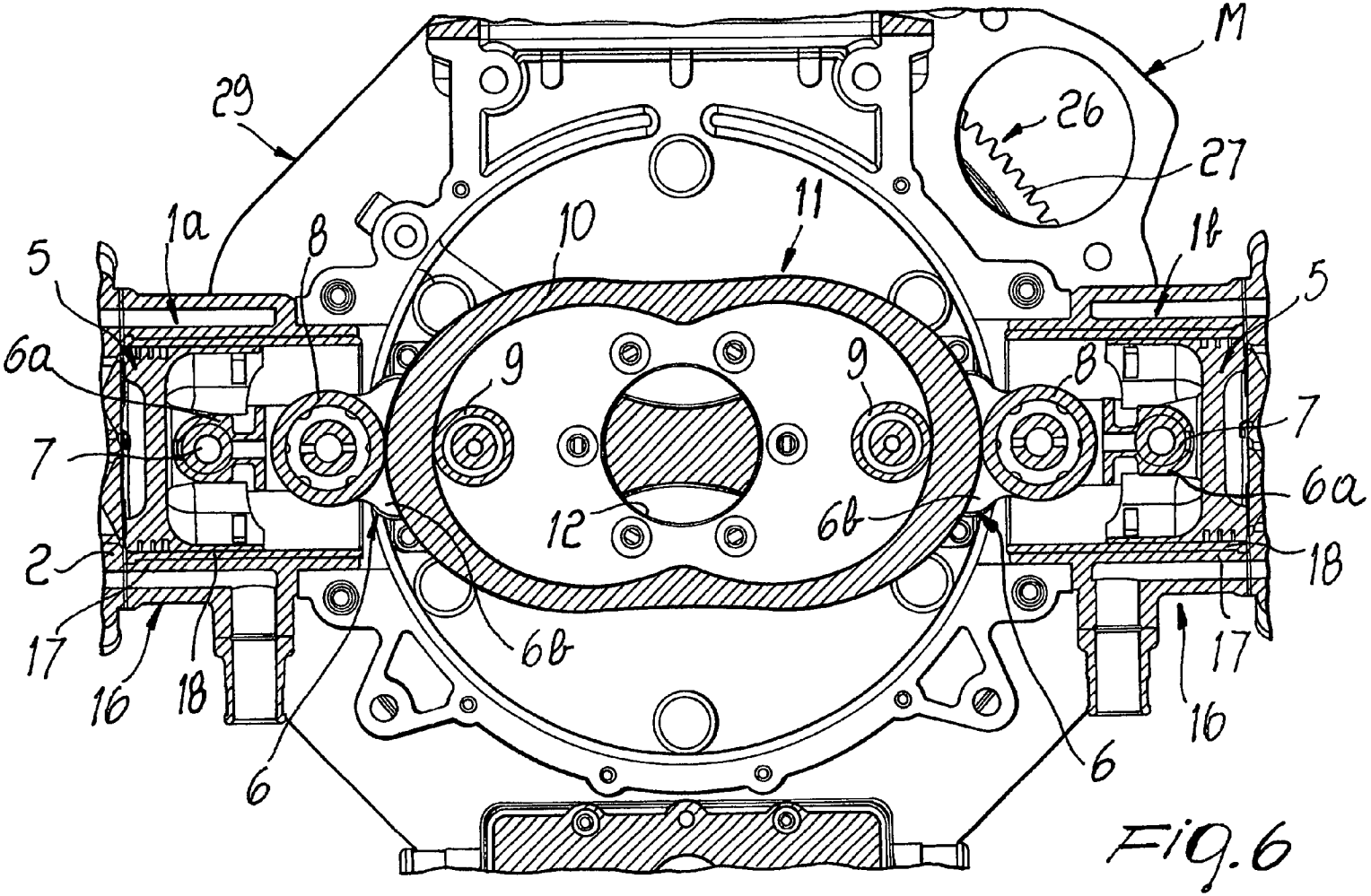
FIG. 6 is a schematic sectional view of the device for converting the reciprocating rectilinear motion of the pistons of the two cylinders of the engine of FIG. 5 into a rotary motion of the driving shaft.

FIGS. 5 and 6 illustrate a possible embodiment of an engine M according to the invention, of the type with two cylinders 1*a* and 1*b* that are mutually diametrically opposite, its pistons 5 being connected by virtue of respective rods 6 and first and second pins 8 and 9 to a central eccentric element 11, which is keyed on the shaft 12 and on which there is a circuit element 10 of the type with two mutually opposite lobes arranged at 180°.

The engine M essentially comprises a block 16, in which there are two sleeves 17 that are diametrically opposite with respect to the axis of the shaft 12; said sleeves accommodate the jackets 18 of the cylinders 1*a* and 1*b*, which are closed by respective heads 2, each of which is provided with respective inlet and exhaust valves, not shown.

The opening and closure of the inlet and exhaust valves is actuated by a mechanism of the type with control rods or tappets 19 that are articulated to respective rockers 20 contained in cases 21 closed by covers 22.

Moreover, at the heads 2 there are injectors 23 for injecting fuel into the chamber 2*a* and exhaust ducts 24.

Moreover, in the block 16 there are interspaces for the circulation of water for cooling the cylinders 1*a* and 1*b*, of which the reference numeral 25 designates the connectors for connection to a corresponding circuit.

A flywheel 26 is keyed on the shaft 12 and is provided with a peripheral toothed ring 27 for coupling to the starter motor.

A throttle body 28 and a plate 29 are interposed between the flywheel 26 and the eccentric element 11.

A lubrication unit 30, comprising a pump 31 that draws from a sump 32 and a filter 33, is arranged below the block 16.

The engine M with two mutually opposite cylinders 1*a* and 1*b* and an eccentric element 11 with two lobes provides balancing of first- and second-order inertia, while inertia torques are not present, obtaining a degree of balancing that is equal to that of a conventional six-cylinder in-line engine.

In practice it has been found that the described invention achieves the proposed aim and objects.

The power in output from the driving shaft increases with respect to an equivalent conventional engine, for an equal displacement and rpm rate, because the number of useful strokes that can be obtained for every revolution of the driving shaft increases.

The motion of the push rod is of the type that reciprocates in a single direction, and accordingly the kinematic behavior of the crank system corresponds to the behavior that would occur in a conventional engine with a connecting rod of infinite length.

The rule of said motion is therefore purely harmonic, generating an acceleration profile that is perfectly cosinusoidal, eliminating all components of order higher than the first.

A direct consequence of this is the elimination of the forces of inertia of the alternating masses of second order, which are one of the most important causes of vibrations of internal-combustion engines, as occurs for example with a flat twin-cylinder engine.

Finally, with the circular arc-like blending regions at the TDC the combustion stroke occurs according to an ideal cycle at constant volume of the Otto type: the push rod and the piston are in fact stationary proximate to the TDC for a presettable rotation angle of the driving shaft during which combustion occurs.

As is known, the cycle of an internal-combustion engine with constant-volume combustion (Otto cycle) is the one that is characterized by the, highest thermodynamic efficiency with respect to other cycles that can be proposed, such as the Diesel cycle or the Sabathé cycle to which the current cycles of spark-ignition and compression-ignition internal-combustion engines can be traced back.

The improved engine according to the invention therefore allows to increase the thermodynamic efficiency of the working fluid transformation cycle and to increase the power in output at the driving shaft.

By modifying the profile of the circuit element it is possible to vary the rule of motion of the pistons, particularly at the combustion stroke.

The invention thus conceived is susceptible of numerous modifications and variations, all of which are within the scope of the inventive concept.

All the details may furthermore be replaced with other technically equivalent ones.

In practice, the materials used, as well as the shapes and the dimensions, may be any according to the requirements without thereby abandoning the scope of the protection of the claims that follow.

The disclosures set forth in Italian Patent Application No. MO2001A000174 of which this application claims priority are incorporated herein by preference.

What is claimed is:

1. A reciprocating internal-combustion engine, of the type comprising at least one hollow cylinder, inside which there is a chamber for the working fluid, said chamber having an end that is closed by a head and an opposite end that is closed by a piston that is adapted to slide with a reciprocating rectilinear motion in said chamber between a bottom dead center, which determines the maximum distance from said head, and a top dead center, which determines the minimum distance from said head, and a device for converting said reciprocating rectilinear motion into a rotary motion of a driving shaft that comprises at least one push rod, which is substantially perpendicular to said shaft and has a first end associated with the piston and a second end provided with pusher elements, and at least one contoured eccentric element that is keyed on said shaft and on which there is a circuit element that is adapted to be followed by said pusher elements that are mechanically connected thereto, the action of the fluid in the chamber imparting to the piston a thrust for actuating the rod with a reciprocating rectilinear motion, with the sliding of the pusher elements along the circuit element so as to transfer said thrust to the eccentric element for the rotary actuation of the driving shaft, characterized in that it comprises adjustment means for adjusting said sliding of the pusher elements along the circuit element which are provided so that when the piston is at least proximate to one of said dead centers, keep the rod and the piston in a substantially stationary configuration for a presettable rotation angle of the driving shaft, said circuit element comprising at least two lobes which are mutually blended and offset at 180° with a different average radius of curvature with respect to the center of said eccentric element, the circuit element being asymmetric with respect to a central axis.

2. The engine of claim 1, wherein said adjustment means are provided so as to keep the rod and the piston in said stationary configuration when the piston is proximate to the top dead center that corresponds to the combustion stroke, during with the volume of the chamber remains substantially constant.

3. The engine of claim 1, wherein said adjustment means are provided so as to keep the rod and the piston in said stationary configuration when the piston is proximate to the top dead center that corresponds to the induction stroke, during which the volume of the chamber remains substantially constant.

4. The engine of claim 1, wherein said adjustment means are provided so as to keep the rod and the piston in said stationary configuration when the piston is proximate to the bottom dead center that corresponds to the exhaust stroke, during which the volume of the chamber remains substantially constant.

5. The engine of claim 1, wherein the profile of said circuit element is constituted by two lobes that are mutually blended and offset at 180° with respect to each other, with two portions for each one of said lobes, the action of the working fluid in the chamber occurring during 360° of revolution of the driving shaft.

6. The engine of claim 1, wherein the profile of said circuit element is constituted by three lobes, which are mutually blended and offset at 120° to each other with two portions for each one of said lobes, the action of the working fluid in the chamber occurring in 240° of revolution of the driving shaft.

7. The engine of claim 1, wherein the profile of said circuit element is constituted by four lobes which are mutually blended and offset at 90° with respect to each other with two portions for each one side lobes, the action of the working fluid in the chamber occurring in 180° of revolution of the driving shaft.

8. The engine of claim 1, wherein said adjustment means comprise a blending region for blending the two portions of at least one of said lobes that is substantially shaped like a circular arc.

9. The engine of claim 1, wherein said adjustment means comprise a blending region for blending at least two contiguous portions of at least two consecutive lobes that is substantially shaped like a circular arc.

10. The engine of claim 9, wherein said circular arc has a breadth comprised between 5 and 60 sexagesimal degrees.

11. The engine of claim 1, wherein said eccentric element comprises a disk-like body that is keyed on said driving shaft and on one face of which there is, in relief, said circuit element, and said pusher elements are constituted by at least one first pin and one second pin that are provided so as to surround said circuit element and to slide along the respective outer and inner profiles.

12. The engine of claim 1, wherein said driving shaft is rectilinear.

13. The engine of claim 1, comprising two said cylinders, which are mutually diametrically opposite with respect to the driving shaft, with pistons thereof being associated with the first end of a respective said push rod, whose second end is provided with respective ones of said pusher elements that are mechanically rigidly coupled to a shaped said eccentric element, which is keyed on said driving shaft and on which there is a circuit element of the type with two lobes that are offset at 180°.

14. A reciprocating internal-combustion engine comprising:

at least one hollow cylinder having a chamber for a working fluid;

a piston slidably arranged in a reciprocating rectilinear manner in said chamber;

a push rod connected to said piston and extending outside said chamber;

a rotating driving shaft;

a rotating circuit element connected to said driving shaft;

a follower slidably arranged on said circuit element and connected to said push rod such that rectilinear motion of said piston causes said circuit element and said driving shaft to rotate;

said circuit element comprising an asymmetric ring extending 360° and having a first arched lobe connected to a second arched lobe mutually interconnected and each of which extend 180°, said first arched lobe having a first average radius of curvature and said second arched lobe having a second average radius of curvature different from said first average radius of curvature.

15. The reciprocating internal-combustion engine of claim 14, said asymmetric ring comprising inner and outer tracks, and said follower comprising a pair of followers sliding respectively on said inner and outer tracks.

* * * * *